US005712603A

United States Patent [19]

Kim et al.

[11] Patent Number: 5,712,603

[45] Date of Patent: Jan. 27, 1998

[54] MULTIPOLE MULTIPOSITION MICROWAVE SWITCH WITH A COMMON REDUNDANCY

[75] Inventors: Duk Yong Kim, Hwansung-Kun, Rep. of Korea; David H. Kim, Santa Fe Springs, Calif.

[73] Assignee: KMW USA, Inc., Santa Fe Springs, Calif.

[21] Appl. No.: 694,600

[22] Filed: Aug. 9, 1996

[51] Int. Cl.[6] ..... H01P 1/10; H01P 5/12

[52] U.S. Cl. ..... 333/101; 333/105

[58] Field of Search ..... 333/101, 103–105; 200/504; 335/4, 5; 330/124 D

[56] References Cited

U.S. PATENT DOCUMENTS

| | | | |
|---|---|---|---|
| 3,681,719 | 8/1972 | Treschitta et al. | 335/5 |
| 3,739,306 | 6/1973 | Sladek . | |
| 3,764,939 | 10/1973 | Stokes . | |
| 3,808,566 | 4/1974 | Thompson et al. | 335/152 |
| 4,167,714 | 9/1979 | Flora | 333/101 |
| 4,187,416 | 2/1980 | Caro . | |
| 4,198,611 | 4/1980 | Eng | 333/105 |
| 4,206,332 | 6/1980 | Veenendaal . | |
| 4,399,439 | 8/1983 | Upadhyayula | 340/825.91 |
| 4,477,781 | 10/1984 | Reuss, Jr. | 330/286 |
| 4,502,027 | 2/1985 | Ayasli | 333/103 |
| 4,583,061 | 4/1986 | O'Shea | 333/116 |
| 4,652,840 | 3/1987 | Kosugi | 333/105 |
| 4,695,811 | 9/1987 | Grellmann et al. | 333/105 |
| 4,697,056 | 9/1987 | Hoffman . | |
| 4,736,171 | 4/1988 | Minarik | 333/24 R |
| 4,755,769 | 7/1988 | Katz | 330/295 |
| 4,779,065 | 10/1988 | Katz et al. | 333/101 |
| 4,795,960 | 1/1989 | Malcolm | 333/105 |
| 4,924,196 | 5/1990 | Uyeda | 333/101 |
| 4,965,542 | 10/1990 | Nelson | 335/5 |
| 4,982,442 | 1/1991 | Sarokhanian | 455/83 |
| 5,065,125 | 11/1991 | Thomson et al. | 335/5 |
| 5,132,644 | 7/1992 | Knorr | 333/105 |
| 5,281,936 | 1/1994 | Ciezarek | 335/4 |
| 5,451,918 | 9/1995 | Sun | 335/4 |
| 5,481,073 | 1/1996 | Singer et al. | 200/1 R |

FOREIGN PATENT DOCUMENTS

| | | | |
|---|---|---|---|
| 577888 | 1/1994 | European Pat. Off. | 333/101 |

OTHER PUBLICATIONS

Teledyne Electronic Technologies' information on DC–22 Ghz Miniture 2P3T Switches Publication date believed to be Oct., 1993.

Teledyne Electronic Technologies' information on DC–26.5 Ghz Miniture Multi–Throw Switches Publication date believed to be Oct., 1993.

*Primary Examiner*—Paul Gensler

*Attorney, Agent, or Firm*—John K. Park; Law Offices of John K. Park & Associates

[57] ABSTRACT

A multipole multiposition microwave switch system 101 with a common redundancy is directed to a new and innovative RF switch that enables the integration of a plurality of high-power RF transmission line switches into one mechanical assembly while giving the system an ability to provide a redundant operation for each of the high-power RF transmission line switches. The invention combines the connectibility of, more particularly, three or more single-pole-double-throw [SPDT] switches and one single-pole-multiple-throw [SPMT] switch to form a single unit of multiple-pole-(multiple plus one)-throw [(N)P(N+1)T] multipole multiposition microwave switch system 101 with a common redundancy. The multipole multiposition microwave switch system 101 achieves the great number of redundancy by having each of the switching mechanisms, along with its input and output RF connectors, parallelly, radially, and commonly connected to the redundant RF connector 123. Because each set of the input and output connectors are commonly and parallelly connected to the redundant connector 123, the number of switches, along with their input and output RF connectors, which can be integrated with the redundant RF connector 123 are not numerically or physically limited. Therefore, this invention allows the packaging of any variety of multiple-pole-(multiple plus one)-throw [(N)P(N+1)T] multipole multiposition microwave switch system 101 with a common redundancy; such as 3P4T, 4P5T, 5P6T, 6P7T, 7T8P, and others with more switches.

15 Claims, 7 Drawing Sheets

MULTIPOLE MULTIPOSITION MICROWAVE SWITCH WITH A COMMON REDUNDANCY

BACKGROUND

This invention relates to a new and innovative system of a multipole multiposition microwave switch system that enables the integration of a plurality of high-power RF transmission line switches into one mechanical assembly while giving the system an ability to provide a redundant operation for each of the high-power RF transmission line switches. The invention combines the connectibility of, more particularly, three or more single-pole-double-throw [SPDT] switches and one single-pole-multiple-throw [SPMT] switch to form a single unit of multiple-pole-(multiple plus one)-throw [(N)P(N+1)T] multipole multiposition microwave switch system. In this invention the term SPMT will describe any one of single-pole-double-throw [SPDT], single-pole-three-throw [SP3T], single-pole-four-throw [SP4T], single-pole-five-throw [SP5T], and so on as the letter "M" indicates the number of throws in a given switch. Similarly, the designation of "N" will also describe a variable to identify the number of coaxial connecting units.

RF coaxial switches are used for transmit-receive switches to switch a single antenna between transmitter and receiver and for many transfer purposes. Each of the transmit-receive switches were often accompanied with a back up means to transmit and to receive as a redundant system. As the number of transmit-receive switches increased, along with their back ups, in order to accommodate the complexity of the operation, several SPDT switches were combined together with one SPMT switch. An example of such a combination would be a group of four individual SPDT's connected to one SP4T switch. As the number of SPDT's increased, the number of external connections increased dramatically.

As the number of connection increased outside the metal housing, and as the frequency of the signal being carried by the system climbed higher, it has been increasingly difficult to maintain optimized impedance match to the active channel, thus obtaining low interference among the signals and low voltage standing wave ratio (VSWR). Also it has been increasingly difficult to maintain adequate RF voltage and RF power handling capabilities while still maintaining good isolation for the unused channels.

For the foregoing reasons, there is a need for a new and innovative system of a multipole multiposition microwave switch system that enables the integration of a plurality of high-power RF transmission line switches into one mechanical assembly, within a controlled housing assembly, while giving the system an ability to provide a redundant operation for each of the high-power RF transmission line switches.

SUMMARY

The present invention is directed to a new and innovative system of a multipole multiposition microwave switch system that enables the integration of a plurality of high-power RF transmission line switches into one mechanical assembly while giving the system an ability to provide a redundant operation for each of the high-power RF transmission line switches. The present invention is able to obtain low interference among the signals because the majority of high frequency RF interconnecting is done inside a controlled housing assembly which provides excellent shielding. The present invention is also able to obtain low voltage loss and low power loss between each high frequency RF interconnections as each interconnection is made by hard wiring, not a connector interface, inside a controlled housing assembly.

The first version of the present invention comprises a housing which encloses all components of the invention.

The housing acts as a electrical shield protecting signals from any external electromagnetic interference.

This first version combines three SPDT switches with one SP3T switch to provide redundancy to the three SPDT switches. Therefore, this version of the multipole multiposition microwave switch system includes a set of three RF input connectors identified as a first RF input connector, a second RF input connector, and a third RF input connector. These three RF input connectors are protruding out of the housing, enabling connections to be made from the outside of the housing. These three RF input connectors are where RF signals are entered into the housing to be relayed to the corresponding RF output connectors.

The housing also has a set of three RF output connectors, identified as a first RF output connector, a second RF output connector, and a third RF output connector. The RF signals from three RF input connectors are relayed to the corresponding three RF output connectors to be sent out of the housing.

The relay mechanism between three RF input connectors and three RF output connectors are three RF switches. The first RF switch is connected between the first RF input connector and the first RF output connector, the second RF switch is connected between the second RF input connector and the second RF output connector, and the third RF switch is connected between the third RF input connector and the third RF output connector. Each of three RF switches is designed to receive a command from a controlling unit. In this version of the invention, the controlling unit may be enclosed within the housing or may be external to the housing.

The housing also has a common RF input connector which is identified as a redundant RF input device. Through this redundant RF input device, the user is enabled to input secondary RF signals for each of the RF output connectors. This connecting point is commonly shared among each of the RF output connectors.

The relay mechanism between the redundant RF input device and each of the RF output connectors are three control switches. The first control switch is connected between the redundant RF input device and the first RF output connector, the second control switch is connected between the redundant RF input device and the second RF output connector, and the third control switch is connected between the redundant RF input device and the third RF output connector. Each of three control switches is designed to receive a command from the controlling unit. The important feature of this invention is that these control switches are positioned radially, making parallel connections, having the common point at the redundant RF input connector. Therefore, forming a 3P4T multipole multiposition microwave switch system.

Because these control switches are positioned radially, making parallel connections, having the common point at the redundant RF input connector, the system can grow easily in its switching capacity by having additional sets of a RF input connector, a RF output connector, a RF switch, and a control switch, wherein the RF switch connects between the RF input connector and the RF output connector, and control switch connects between the redundant RF input device and the RF output connector. Therefore each of these additional sets radially and parallelly oriented around the redundant RF input device, we now have an increasing multiple-pole-(multiple plus one)-throw [(N)P (N+1)T] multipole multiposition microwave switch system. Therefore, for the first time, 3P4T, 4P5T, 5P6T, 6P7T, 7TSP, and others with more switches are possible within one packaging.

The second version of the invention further comprises of a means for commanding each of the RF switches and each of the control switches wherein the means for commanding is able to control each RF switch and each control switch individually. This means for commanding each of the RF switches and each of the control switches can either be housed within the housing or packaged separately outside the housing.

The third version of the invention also comprises of a plurality of interface blades having two ends. Each of the interface blades has two ends wherein about the middle portion of the interface blade is pivoted so that each end is free to move about the pivot. The interface blade is pivoted about the middle portion of the interface blade so any movement of one end of the interface blade is countered by the other end but in opposite direction.

The third version of the invention also comprises of a means for commanding each of the interface blades wherein each of the interface blades will command their corresponding RF switch and control switch. Because the interface blade is positioned between its corresponding RF switch and its corresponding control switch, a single command to toggle the interface blade will make or break the appropriate electrical connection with the corresponding RF switch and the control switch.

The prior art in this field is to combine several SPDT switches with one SPMT switch. An example of such a combination would be a group of four individual SPDT's connected to one SP4T switch (see FIG. 1). One difficulty with such a combination of a multiple SPDT's with a SPMT is that as the number of SPDT's increased, the number of external connections increased dramatically. And as the number of connection increased outside the metal housing, and as the frequency of the signal being carried by the system climbed higher, it has been increasingly difficult to maintain optimized impedance match to the active channel.

Therefore, it is also difficult to obtain low interference among the signals and low voltage standing wave ratio. Additionally, it has been increasingly difficult to maintain adequate RF voltage and RF power handling capabilities while still maintaining good isolation for the unused channels.

Contrast to this prior art, this invention does not require any external connection between any SPDT's and SPMT. Therefore, it is easier to maintain the optimized impedance match to the active channel, and easier to obtain low interference among the signals. Additionally, because the number of connectors required is reduced, the voltage loss is also minimized; increasing the RF power handling efficiency.

Another prior art in this field is to have double-pole triple-throw [2P3T](see FIG. 2). This concept, however, is limited to the switching-ability of 2P3T, because the switches were oriented serially with the redundant RF connector.

Contrast to this prior art, the breakthrough in this new and improved invention is that this multipole multiposition microwave switch system orients its switches parallelly and radially with the redundant RF connector. Therefore, because each of the switching mechanism along with its input and output RF connectors are parallelly, radially, and commonly connected to the redundant RF connector, the number of switches along with their input and output RF connectors are not physically limited. Therefore, this invention allows the packaging of any variety of multiple-pole-(multiple plus one)-throw [(N)P(N+1)T] multipole multiposition microwave switch system; such as 3P4T, 4P5T, 5P6T, 6P7T, 7TSP, and others with more switches.

One additional advantage is the simplicity of the invention. Many of the SPDT's can now be combined within one packaging because of this invention. This feature is especially important when the system requires high frequency of switching as the simplicity of the design and the single redundant connection shared among many channels reduce the probability of the system failure. Moreover, because there is not a need for wiring between switches, the present invention requires less operator's valuable time.

DRAWINGS

These and other features, aspects, and advantages of the present invention will become better understood with regard to the following description, appended claims, and accompanying drawings where:

DESCRIPTION

With reference to the figures, several embodiments of the multipole multiposition microwave switch system according to the present invention are illustrated.

Figures 3, 4, 5:
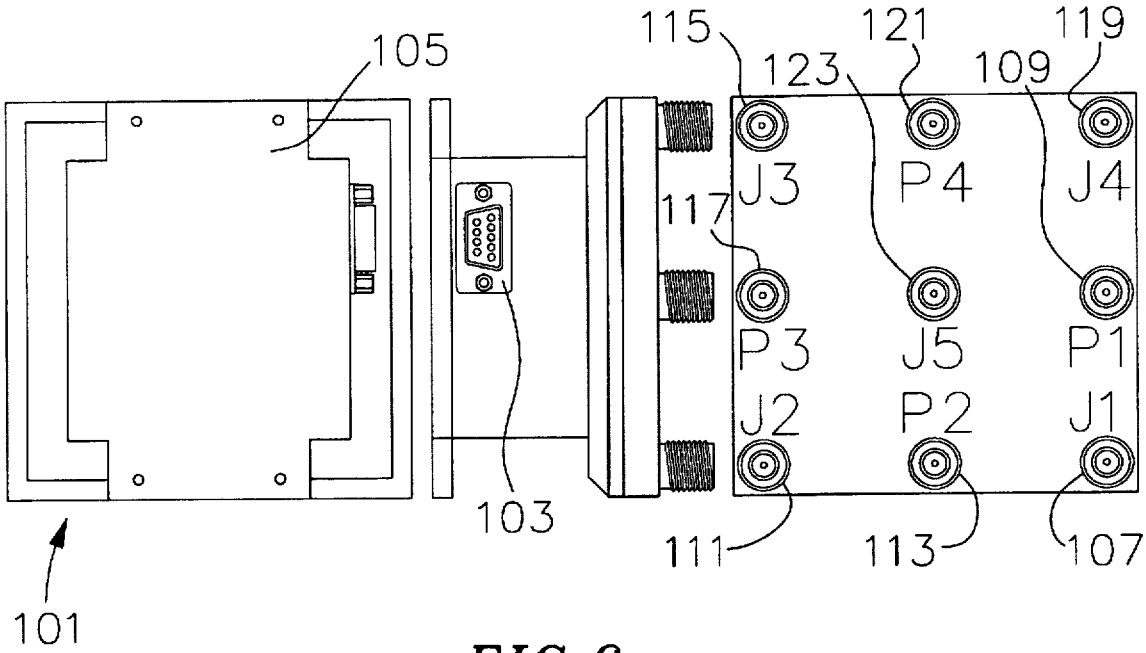
FIG. 3 is a bottom view of the multipole multiposition microwave switch system of 4P5T.
FIG. 4 is a side view of the multipole multiposition microwave switch system of 4P5T.
FIG. 5 is a top plan view of the multipole multiposition microwave switch system of 4P5T.

FIG. 3, FIG. 4, and FIG. 5 show a bottom view, a side view, and a top plan view of a multipole multiposition microwave switch system 101 respectively. FIG. 3 and FIG. 4 show a standard "D" shape connector 103, protruding out of a housing 105 of the multipole multiposition microwave switch system 101. The standard "D" shape connector 103 carries the control commands to control the switching of plurality of switches within the multipole multiposition microwave switch system 101.

FIG. 3, FIG. 4 and FIG. 5 illustrate the outward appearance of a 4P5T embodiment of the multipole multiposition microwave switch system 101. This embodiment comprises of a first RF input connector 107 and a first RF output connector 109, a second RF input connector 111 and a second RF output connector 113, a third RF input connector 115 and a third RF output connector 117, a fourth RF input connector 119 and a fourth RF output connector 121, and a redundant RF input connector 123.

Figure 6:
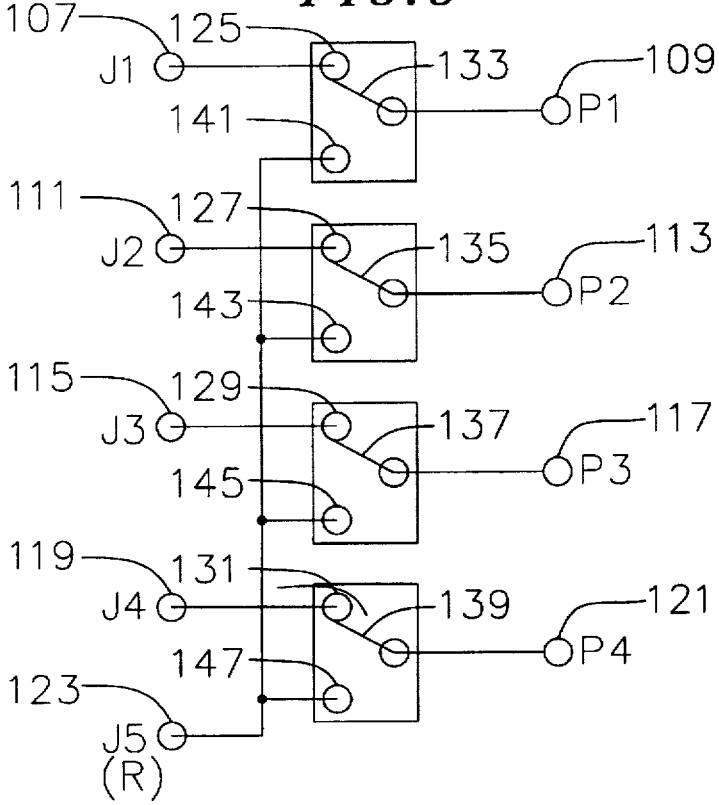
FIG. 6 is a schematic of the multipole multiposition microwave switch system of 4P5T.

FIG. 6 is a schematic of the multipole multiposition microwave switch system 101 of 4P5T. This schematic illustrates the simplicity of the multipole multiposition microwave switch system 101.

As illustrated in the schematic, the first RF input connector 107 is connected to a first RF switch 125, the second RF input connector 111 is connected to a second RF switch 127, the third RF input connector 115 is connected to a third RF switch 129, and the fourth RF input connector 119 is connected to a fourth RF switch 131. Similarly, the first RF output connector 109 is connected to a first interface blade 133, the second RF output connector 113 is connected to a second interface blade 135, the third RF output connector 117 is connected to a third interface blade 137, and the fourth RF output connector 121 is connected to a fourth interface blade 139.

The redundant RF input connector 123 is commonly and parallelly connected to a first control switch 141, a second control switch 143, a third control switch 145, and a fourth control switch 147. Because the redundant RF input connector 123 is commonly and parallelly connected to the first control switch 141, the second control switch 143, the third control switch 145, and the fourth control switch 147, one can observe that a single external connection point provided by the redundant RF input connector 123 can give a redundant electrical path to each of the first control switch 141, the second control switch 143, the third control switch 145, and the fourth control switch 147.

As the interface blades 133, 135, 137, and 139, toggle between their corresponding RF switches 125, 127, 129, and 131, and corresponding control switches 141, 143, 145, and 147, each of the electrical inputs carried by the RF input connectors 107, 111, 115, and 119 or a single redundant RF input carried by connector 123 can now be transmitted to the corresponding RF output connectors 109, 113, 117, and 121.

Figure 7:
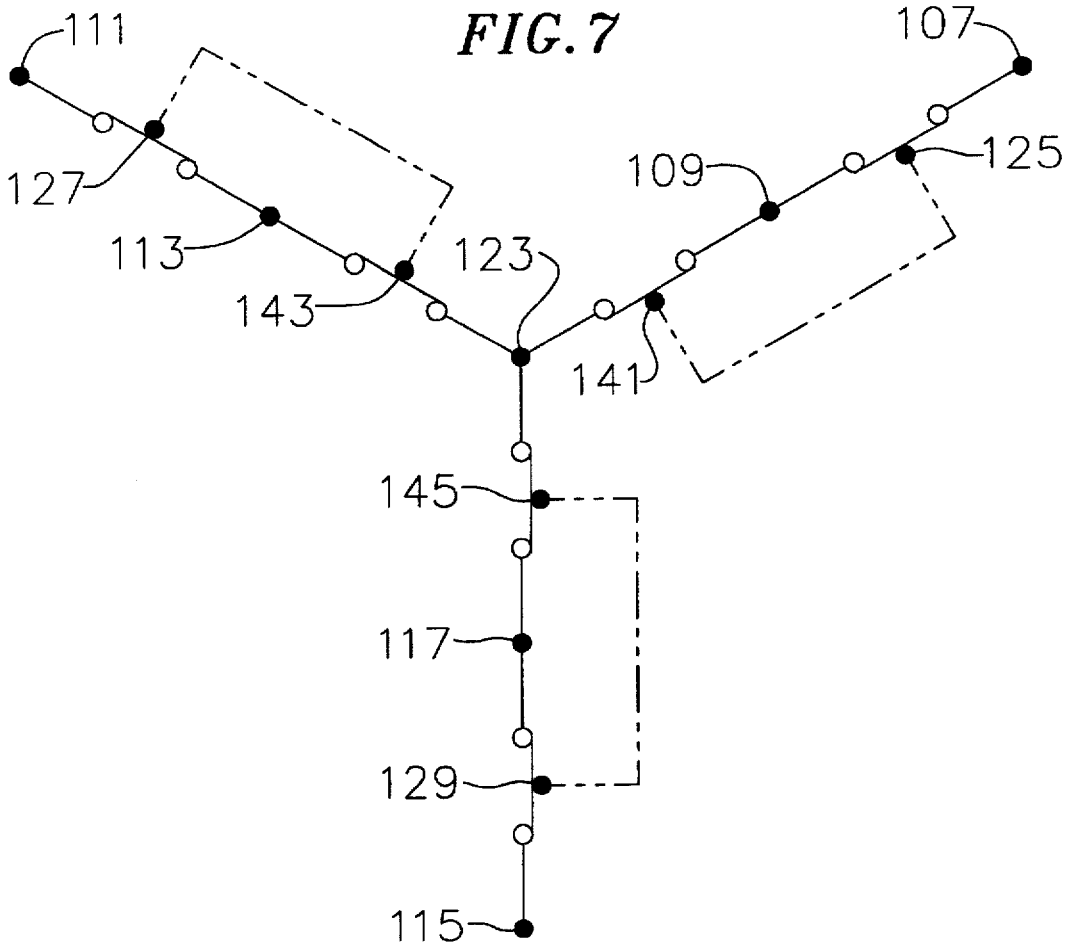
FIG. 7 is a simplified line schematic of the multipole multiposition microwave switch system of 3P4T.

FIG. 7 is a simplified line schematic of another version of the multipole multiposition microwave switch system 101, a 3P4T system. Although the first interface blade 133, the second interface blade 135, and the third interface blade 137 are not shown for the simplicity of the schematic, the simplest form of the present invention is fully illustrated. From FIG. 7, one can observe that the redundant RF input connector 123 is commonly and serially connected to each of three control switches 141, 143, 145.

Figure 8:
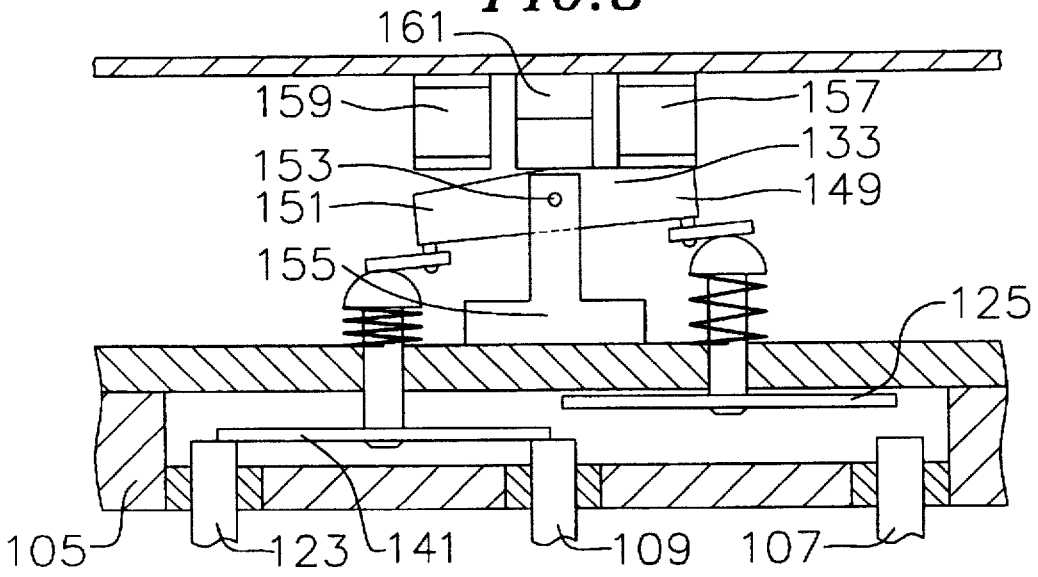
FIG. 8 is a simplified cross-sectional view of the means for commanding each of the RF switches and each of the control switches by the use of a corresponding interface blade.

FIG. 8 is a simplified cross-sectional view of the means for commanding each of the RF switches 125, 127, 129, and 131, and each of the control switches 141, 143, 145, and 147 by the use of corresponding interface blades 133, 135, 137, and 139. As shown in FIG. 8, the first RF input connector 107, the first output connector 109, and the redundant RF input connector 123 are protruding out of the housing 105.

The first control switch 141 has two ends wherein one end can make an electrical contact with the redundant RF input connector 123 and the other end can make an electrical contact with the first RF output connector 109. The first control switch 141 is made of electrically conductive material so that when two ends of the first control switch 141 are making electrical contact with the redundant RF input connector 123 and the first RF output connector 109, an electrical circuit between the redundant RF input connector 123 and the first RF output connector 109 is complete.

The first RF switch 125 has two ends wherein one end can make an electrical contact with the first RF input connector 107 and the other end can make an electrical contact with the first RF output connector 109. The first RF switch 125 is made of electrically conductive material so that when two ends of the first RF switch 125 are making electrical contact with the first RF input connector 107 and the first RF output connector 109, an electrical circuit between the first RF input connector 107 and the first RF output connector 109 is complete.

As shown in FIG. 8, the first interface blade 133 is positioned between the first control switch 141 and the first RF switch 125. The first interface blade 133 has a first end of the first interface blade 149, a second end of the first interface blade 151, and a middle portion of the first interface blade 153. The first end of the first interface blade 149 is attached to an extension from the first RF switch 125, the second end of the first interface blade 151 is attached to an extension from the first control switch 141, and a middle portion of the first interface blade 153 is pivotally hinged on a first interface blade support 155 which is securely attached to the housing 105.

Oppositely placed from the first interface blade support 155 are a first solenoid 157 for the first end of the first interface blade 149, a second solenoid 159 for the second end of the first interface blade 151, a permanent magnet 161 for the first interface blade 133. An operator can control the toggling of the first end of the first interface blade 149 and the second end of the first interface blade 151 by selectively sending the current to either the first solenoid 157 for the first end of the first interface blade 159, or the second solenoid 159 for the second end of the first interface blade 159. Because the middle portion of the first interface blade 153 is rotably pivoted on the first interface blade support 155, the first interface blade 133 will seesaw back and forth, enabling the switching on and off of both the first RF switch 125 and the first control switch 141.

Figure 9:
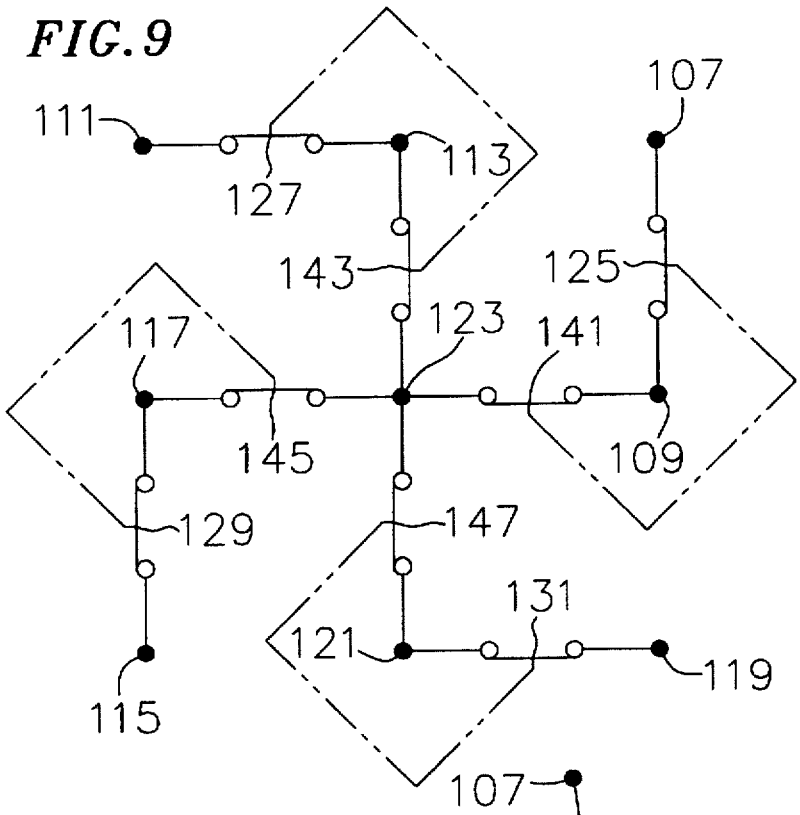
FIG. 9 is a simplified line schematic of the multipole multiposition microwave switch system of 4P5T.

FIG. 9 is a simplified line schematic of the multipole multiposition microwave switch system 101 of 4P5T which is illustrated in FIG. 3, FIG. 4, FIG. 5, and FIG. 6. Similar to FIG. 7, the first interface blade 133, the second interface blade 135, the third interface blade 137, and the fourth interface blade 139 are not shown for the simplicity of the schematic. From FIG. 9, one can once again observe that the redundant RF input connector 113 is commonly and serially connected to each of four control switches 141, 143, 145, 147.

Figure 10:
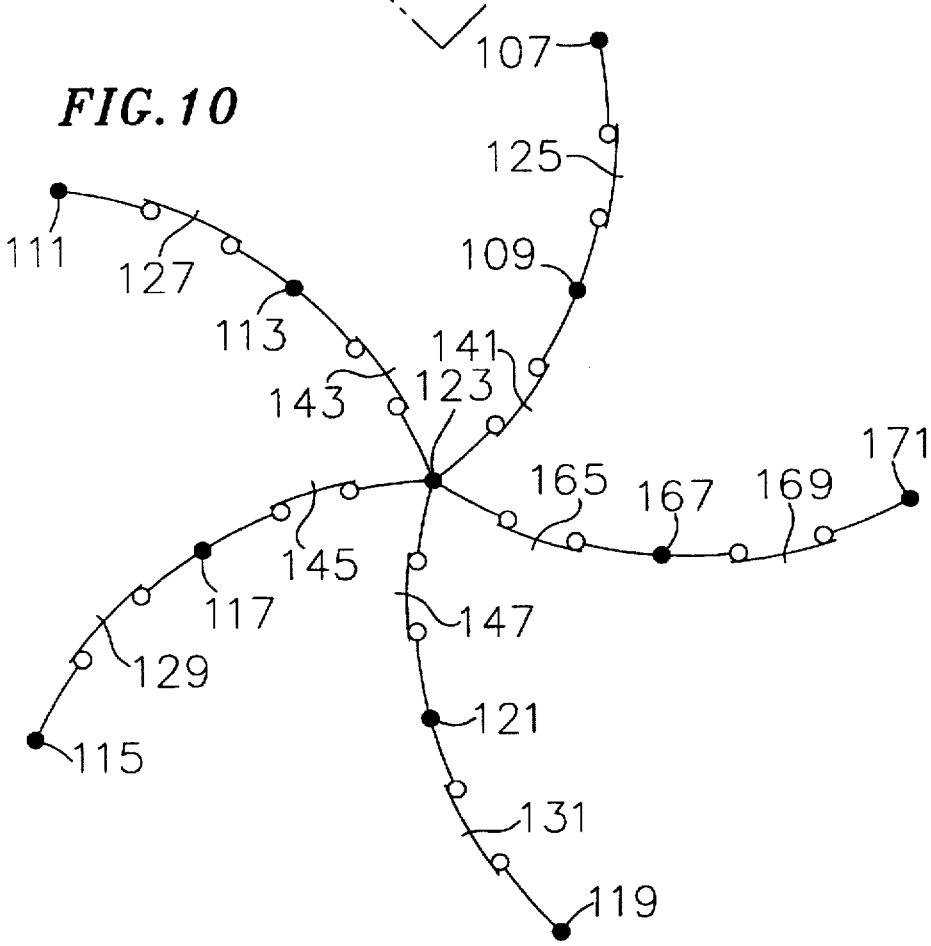
FIG. 10 is a simplified line schematic of the multipole multiposition microwave switch system of 5P6T.

FIG. 10 is a simplified line schematic of the multipole multiposition microwave switch system 101 of 5P6T. Similar to FIG. 7 and FIG. 9, the first interface blade 133, the second interface blade 135, the third interface blade 137, the fourth interface blade 139, and a fifth interface blade 163 (shown in FIG. 13) are not shown for the simplicity of the schematic. From FIG. 10, one can once again observe that the redundant RF input connector 123 is commonly and serially connected to each of four control switches 141, 143, 145, 147, and with a fifth control switch 165. The fifth control switch 165 connects between the redundant RF input connector 123 and a fifth RF output connector 167. Also, a fifth RF switch 169 connects between the fifth RF output connector 167 and a fifth RF input connector 171.

Figure 11:
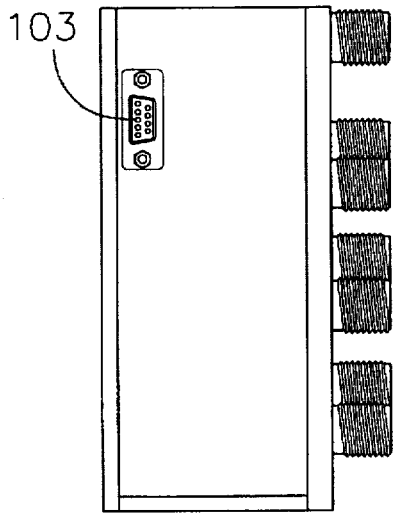
FIG. 11 is a side view of the multipole multiposition microwave switch system of 5P6T.
Figure 12:
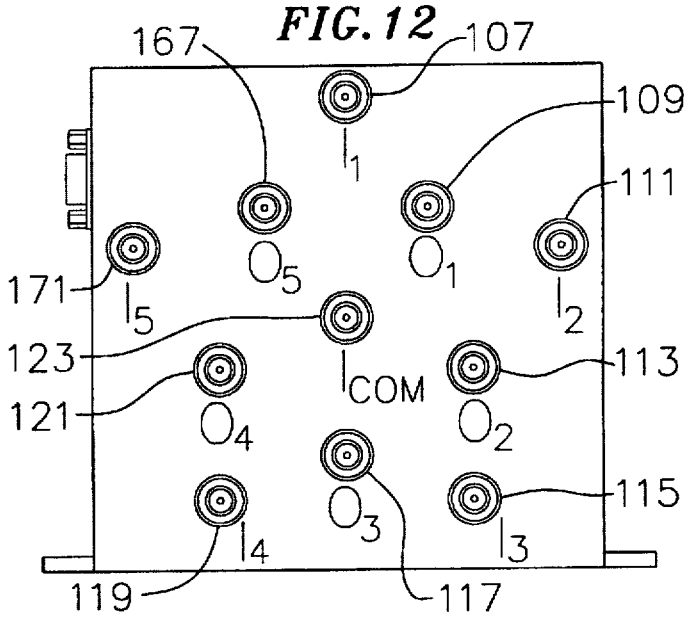
FIG. 12 is a top plan view of the multipole multiposition microwave switch system of 5P6T.

FIG. 11, and FIG. 12 show a side view, and a top plan view of the multipole multiposition microwave switch system 101 of 5P6T respectively. FIG. 11, and FIG. 12 also show the standard "D" shape connector 103, protruding out of a housing 105 of the multipole multiposition microwave switch system 101. The standard "D" shape connector 103 carries the control commands to control the switching of plurality of switches within the multipole multiposition microwave switch system 101.

The embodiment of 5P6T comprises of the first RF input connector 107 and the first RF output connector 109, the second RF input connector 111 and the second RF output connector 113, the third RF input connector 115 and the third RF output connector 117, the fourth RF input connector 119 and the fourth RF output connector 121, the fifth RF input connector 171 and the fifth RF output connector 167, and the redundant RF input connector 123.

Figure 13:
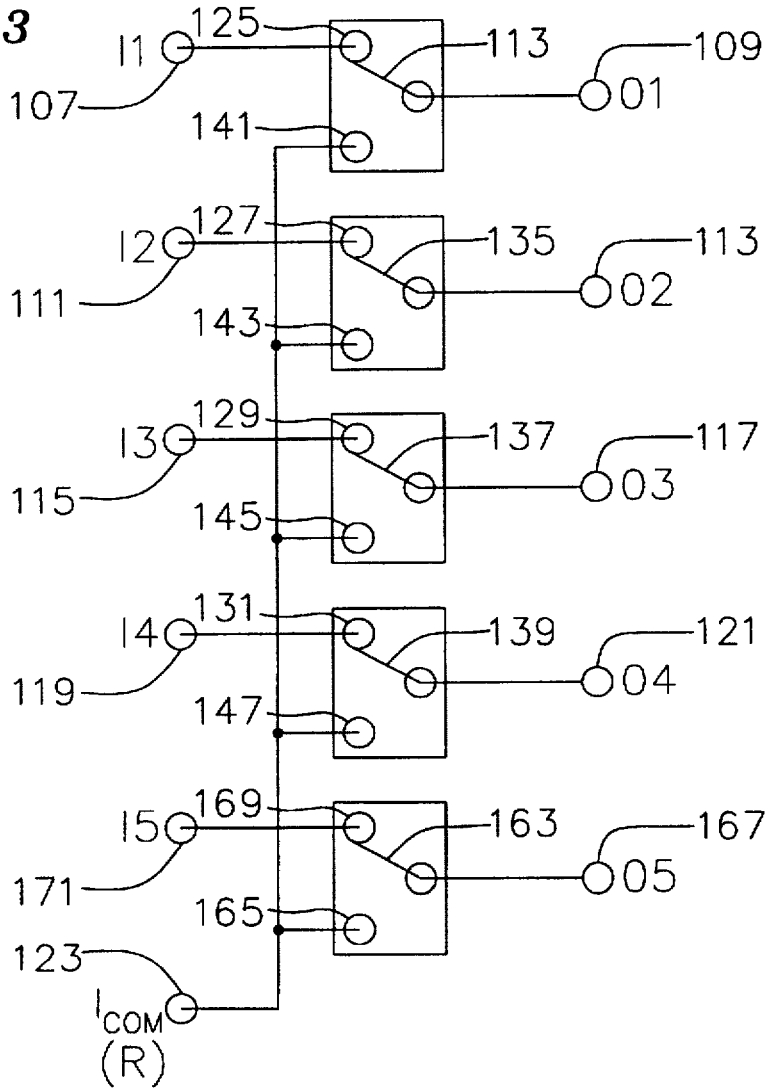
FIG. 13 is a schematic of the multipole multiposition microwave switch system of 4P5T.

FIG. 13 is a schematic of the multipole multiposition microwave switch system 101 of 5P6T. In addition to the elements shown in FIG. 6, FIG. 13 also shows the fifth interface blade 163, the fifth control switch 165, the fifth RF output connector 167, fifth RF switch 169, and the fifth RF input connector 171.

Figure 14:
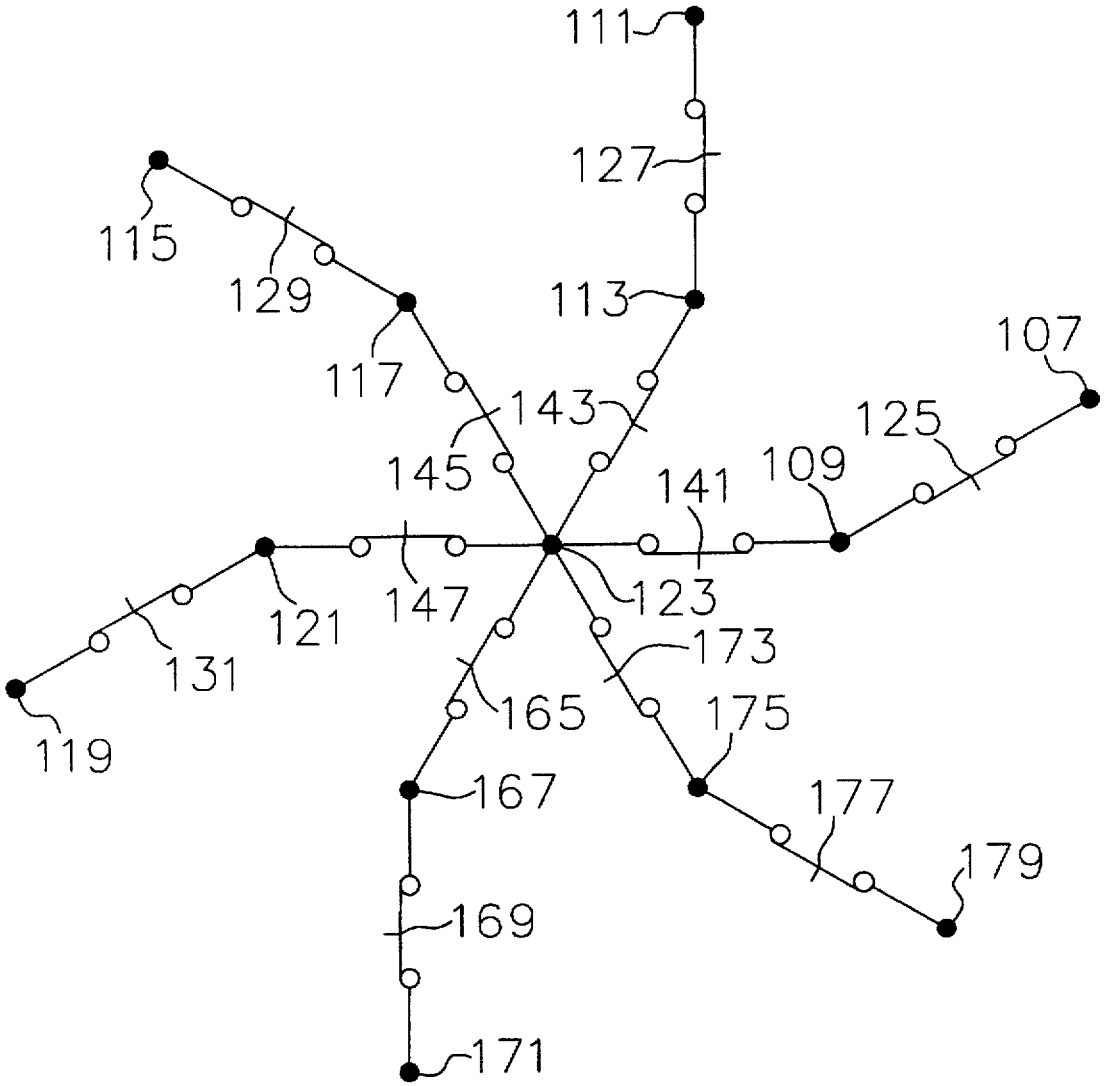
FIG. 14 is a simplified line schematic of the multipole multiposition microwave switch system of 6P7T.

FIG. 14 is a simplified line schematic of the multipole multiposition microwave switch system 101 of 6P7T. Similar to FIG. 7, FIG. 9, and FIG. 10, the first interface blade 133, the second interface blade 135, the third interface blade 137, the fourth interface blade 139, the fifth interface blade 163, a sixth interface blade are not shown for the simplicity of the schematic.

From FIG. 14, one can once again observe that the redundant RF input connector 123 is commonly and serially connected to each of five control switches 141, 143, 145, 147, 165 and with a sixth control switch 173. The sixth control switch 173 connects between the redundant RF input connector 123 and a sixth RF output connector 175. Also, a sixth RF switch 177 connects between the sixth RF output connector 175 and a sixth RF input connector 179.

As shown in FIG. 7, FIG. 9, FIG. 10, and FIG. 14, because each of the switching mechanisms along with its input and output RF connectors are parallelly, radially, and commonly connected to the redundant RF connector 123, the number of switches along with their input and output RF connectors are not physically limited. Therefore, this invention allows the packaging of any variety of multiple-pole-(multiple plus one)-throw [(N)P(N+1)T] multipole multiposition microwave switch system; such as 3P4T, 4P5T, 5P6T, 6P7T, 7T8P, and others with more switches.

Figure 15:
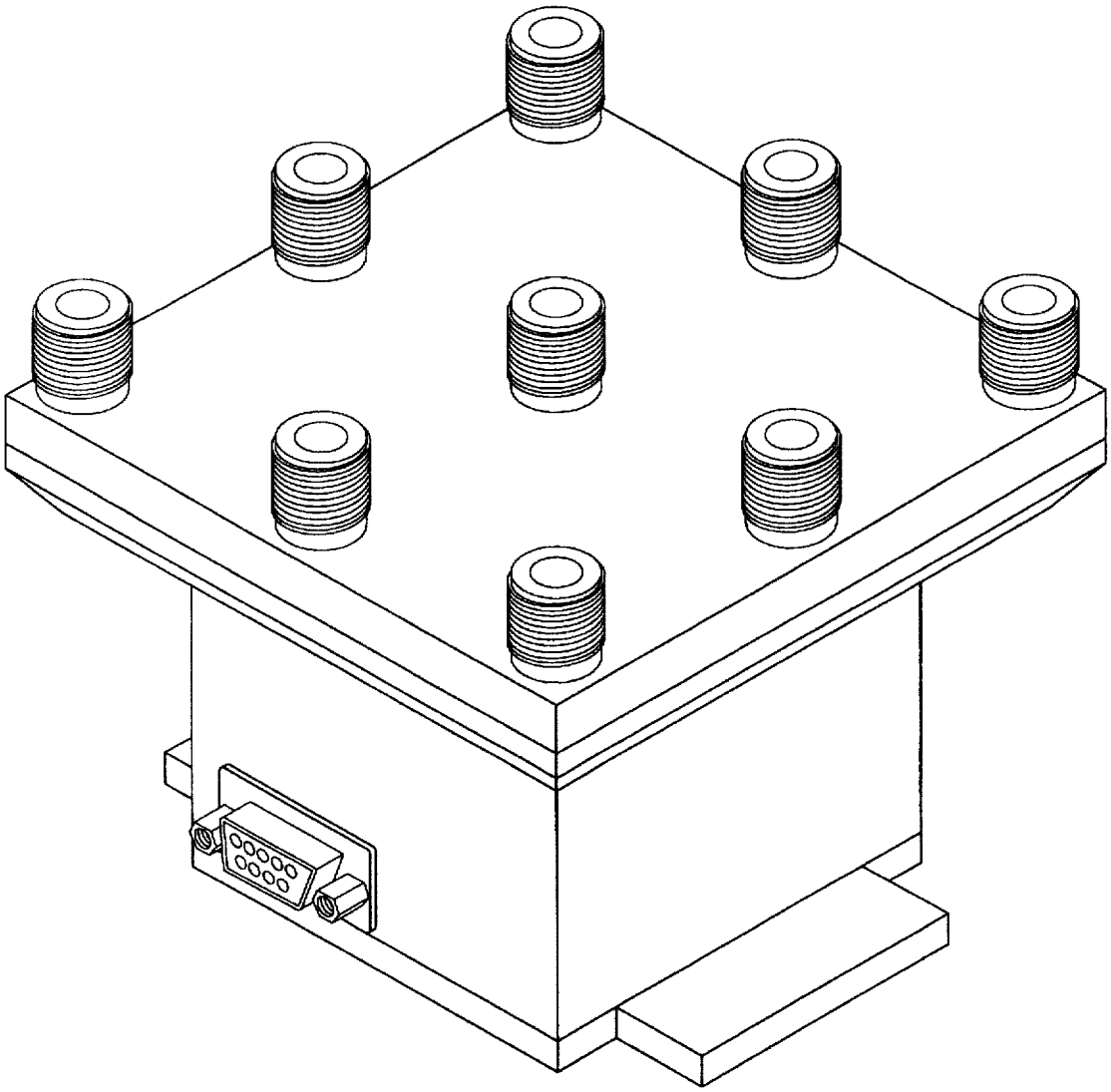
FIG. 15 is an isometric view of the multipole multiposition microwave switch system of 4P5T.

FIG. 15 is an isometric view of the multipole multiposition microwave switch system 101 of 4P5T. The simplicity of the design is apparent.

Figure 1:
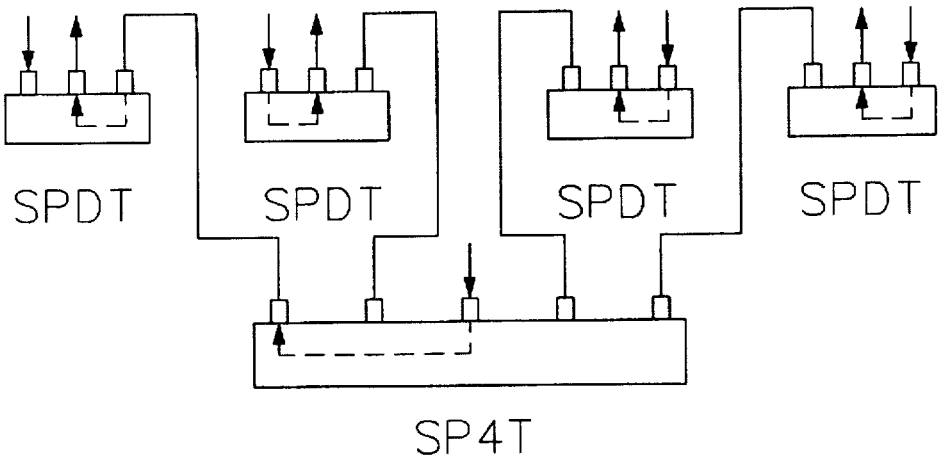
FIG. 1 (PRIOR ART)
FIG. 1 is schematic depicting a prior art which combines a several SPDT switches with one SPMT switch.
Figure 2:
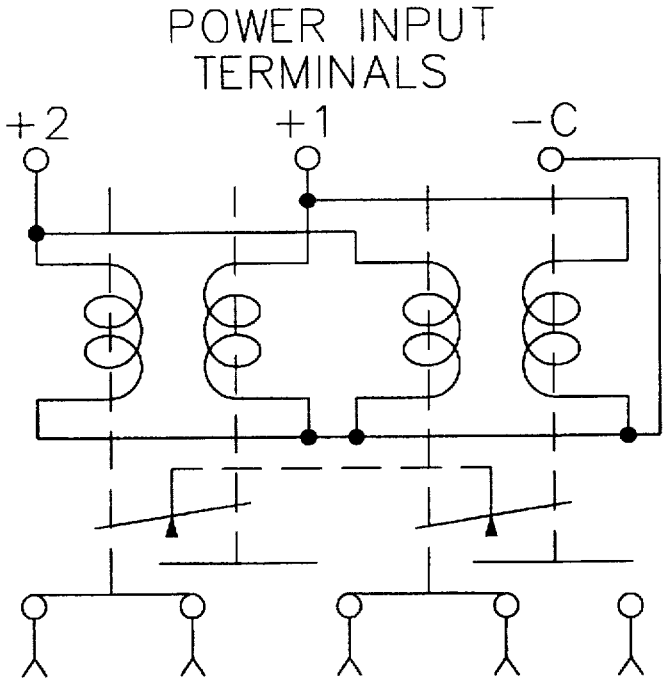
FIG. 2 (PRIOR ART)
FIG. 2 is a schematic depicting a prior art of double-pole triple-throw [2P3T].

Contrast to the present invention, a prior art in this field is illustrated by FIG. 1. In this prior art, several SPDT switches are combined with one SPMT switch. FIG. 1 shows an example of such a combination which has a group of four individual SPDT's connected to one SP4T switch. One difficulty with such a combination of multiple SPDT's with a SPMT is that as the number of SPDT's increased, the number of external connections increased dramatically. And as the number of connections increased outside the metal housing, and as the frequency of the signal being carried by the system climbed higher, it has been increasingly difficult to maintain optimized impedance match to the active channel. Therefore, it is also difficult to obtain low interference among the signals and low voltage standing wave ratio. Additionally, it has been increasingly difficult to maintain adequate RF voltage and RF power handling capabilities while still maintaining good isolation for the unused channels.

However, as seen in the figures, this invention does not require any external connections to form a [(N)P(N+1)T]. Therefore, it is easier to maintain the optimized impedance match to the active channel, and easier to obtain low interference among the signals. Additionally, because the number of connectors required is reduced, the voltage loss is also minimized, increasing the RF power handling efficiency.

Contrast to the present invention, another prior art in this field is to have double-pole triple-throw [2P3T]. This concept, however, is limited to the switching-ability of 2P3T, because the switches were oriented serially with the redundant RF input connector 123.

However, as seen in the figures, because each of the switching mechanisms along with its input and output RF connectors are parallelly, radially, and commonly connected to the redundant RF input connector 123, the number of switches along with their input and output RF connectors are not physically limited. Therefore, this invention allows the packaging of any variety of multiple-pole-(multiple plus one)-throw [(N)P(N+1)T] multipole multiposition microwave switch system; such as 3P4T, 4P5T, 5P6T, 6P7T, 7T8P, and others with more switches.

One additional advantage is the simplicity of the invention. Many of the SPDT's can now be combined within one packaging because of this invention. This feature is especially important when the system requires high frequency of switching as the simplicity of the design and the single redundant connection shared among many channels reduce the probability of the system failure. Moreover, because there is not a need for wiring between switches, the present invention requires less operator's valuable time.

Although the present invention has been described in considerable detail with reference to certain preferred versions thereof, other versions are possible. For example the multipole multiposition microwave switch system 101 can have a different means of switching each of the control switches and the RF switches without using the interface blades. Such a different means may be a use of a group of solenoids to differently activate each of the control switches and the RF switches.

Another version of this invention is a reverse system of what has been illustrated. Instead of the redundant RF input connector 123, the redundancy can be provided in a RF output connector. Therefore, the spirit and the scope of the appended claims should not be limited to the description of the preferred versions contained herein.

What I claim is:

1. A multipole multiposition microwave switch system with a common redundancy comprising a) a housing;

b) a first RF input connector, a second RF input connector, and a third RF input connector attached to the housing;

c) a first RF output connector, a second RF output connector, and a third RF output connector attached to the housing;

d) a first RF switch connected between the first RF input connector and the first RF output connector;

e) a second RF switch is connected between the second RF input connector and the second RF output connector;

f) a third RF switch is connected between the third RF input connector and the third RF output connector;

g) a redundant RF input device attached to the housing;

h) a first control switch is connected directly between the redundant RF input device and the first RF output connector;

i) a second control switch is connected directly between the redundant RF input device and the second RF output connector; and j) a third control switch is connected directly between the redundant RF input device and the third RF output connector.

2. The multipole multiposition microwave switch system with a common redundancy of claim 1 further comprising a) a fourth RF input connector attached to the housing;

b) a fourth RF output connector attached to the housing;

c) a fourth RF switch wherein the fourth RF switch is connected between the fourth RF input connector and the fourth RF output connector; and d) a fourth control switch wherein the fourth control switch is connected between the redundant RF input device and the fourth RF output connector.

3. The multipole multiposition microwave switch system with a common redundancy of claim 2 further comprising a) a fifth RF input connector attached to the housing;

b) a fifth RF output connector attached to the housing;

c) a fifth RF switch wherein the fifth RF switch is connected between the fifth RF input connector and the fifth RF output connector; and d) a fifth control switch wherein the fifth control switch is connected between the redundant RF input device and the fifth RF output connector.

4. The multipole multiposition microwave switch system with a common redundancy of claim 3 further comprising a) a sixth RF input connector attached to the housing;

b) a sixth RF output connector attached to the housing;

c) a sixth RF switch wherein the sixth RF switch is connected between the sixth RF input connector and the sixth RF output connector; and d) a sixth control switch wherein the sixth control switch is connected between the redundant RF input device and the sixth RF output connector.

5. The multipole multiposition microwave switch system with a common redundancy of claim 4 further comprising a) a seventh RF input connector attached to the housing;

b) a seventh RF output connector attached to the housing;

c) a seventh RF switch wherein the seventh RF switch is connected between the seventh RF input connector and the seventh RF output connector; and d) a seventh control switch wherein the seventh control switch is connected between the redundant RF input device and the seventh RF output connector.

6. An multipole multiposition microwave switch system with a common redundancy comprising a) a housing;

b) a first RF input connector, a second RF input connector, and a third RF input connector attached to the housing;

c) a first RF output connector, a second RF output connector, and a third RF output connector attached to the housing;

d) a first RF switch connected between the first RF input connector and the first RF output connector;

e) a second RF switch is connected between the second RF input connector and the second RF output connector;

f) a third RF switch is connected between the third RF input connector and the third RF output connector;

g) a redundant RF input device attached to the housing;

h) a first control switch is connected between the redundant RF input device and the first RF output connector;

i) a second control switch is connected between the redundant RF input device and the second RF output connector;

j) a third control switch is connected between the redundant RF input device and the third RF output connector; and k) a means for commanding each of the RF switches and each of the control switches wherein the means for commanding is able to control each RF switch and each control switch individually.

7. The multipole multiposition microwave switch system with a common redundancy of claim 6 further comprising a) a fourth RF input connector attached to the housing;

b) a fourth RF output connector attached to the housing;

c) a fourth RF switch wherein the fourth RF switch is connected between the fourth RF input connector and the fourth RF output connector; and d) a fourth control switch wherein the fourth control switch is connected between the redundant RF input device and the fourth RF output connector.

8. The multipole multiposition microwave switch system with a common redundancy of claim 7 further comprising a) a fifth RF input connector attached to the housing;

b) a fifth RF output connector attached to the housing;

c) a fifth RF switch wherein the fifth RF switch is connected between the fifth RF input connector and the fifth RF output connector; and d) a fifth control switch wherein the fifth control switch is connected between the redundant RF input device and the fifth RF output connector.

9. The multipole multiposition microwave switch system with a common redundancy of claim 8 further comprising a) a sixth RF input connector attached to the housing;

b) a sixth RF output connector attached to the housing;

c) a sixth RF switch wherein the sixth RF switch is connected between the sixth RF input connector and the sixth RF output connector; and d) a sixth control switch wherein the sixth control switch is connected between the redundant RF input device and the sixth RF output connector.

10. The multipole multiposition microwave switch system with a common redundancy of claim 9 further comprising a) a seventh RF input connector attached to the housing;

b) a seventh RF output connector attached to the housing;

c) a seventh RF switch wherein the seventh RF switch is connected between the seventh RF input connector and the seventh RF output connector; and d) a seventh control switch wherein the seventh control switch is connected between the redundant RF input device and the seventh RF output connector.

11. An multipole multiposition microwave switch system with a common redundancy comprising a) a housing;

b) a first RF input connector, a second RF input connector, and a third RF input connector attached to the housing;

c) a first RF output connector, a second RF output connector, and a third RF output connector attached to the housing;

d) a first RF switch connected between the first RF input connector and the first RF output connector;

e) a second RF switch is connected between the second RF input connector and the second RF output connector;

f) a third RF switch is connected between the third RF input connector and the third RF output connector;

g) a redundant RF input device attached to the housing;

h) a first control switch is connected directly between the redundant RF input device and the first RF output connector;

i) a second control switch is connected directly between the redundant RF input device and the second RF output connector;

j) a third control switch is connected directly between the redundant RF input device and the third RF output connector;

k) a first interface blade having a first end of the first interface blade, a second end of the first interface blade and a middle portion of the first interface blade, wherein the first interface blade is positioned between the first RF switch and the first control switch so that the first end of the first interface blade is attached to the first RF switch and the second end of the first interface blade is attached to the first control switch, and wherein the first interface blade is pivoted about the middle portion of the first interface blade so any movement of the first end of the first interface blade is countered by the second end of the first interface blade but in opposite direction;

1) a second interface blade having a first end of the second interface blade, a second end of the second interface blade and a middle portion of the first interface blade, wherein the second interface blade is positioned between the second RF switch and the second control switch so that the first end of the second interface blade is able to make a contact with the second RF switch and the second end of the second interface blade is able to make a contact with the second control switch, and wherein the second interface blade is pivoted about the middle portion of the second interface blade so any movement of the first end of the second interface blade is countered by the second end of the second interface blade but in opposite direction;

m) a third interface blade having a first end of the third interface blade, a second end of the third interface blade and a middle portion of the first interface blade, wherein the third interface blade is positioned between the third RF switch and the third control switch so that the first end of the third interface blade is able to make a contact with the third RF switch and the second end of the third interface blade is able to make a contact with the third control switch, and wherein the third interface blade is pivoted about the middle portion of the third interface blade so any movement of the first end of the third interface blade is countered by the third end of the third interface blade but in opposite direction; and n) a means for commanding each of the interface blades wherein each of the interface blades will command their corresponding RF switch and control switch.

12. The multipole multiposition microwave switch system with a common redundancy of claim 11 further comprising a) a fourth RF input connector attached to the housing;

b) a fourth RF output connector attached to the housing;

c) a fourth RF switch wherein the fourth RF switch is connected between the fourth RF input connector and the fourth RF output connector; and d) a fourth control switch wherein the fourth control switch is connected between the redundant RF input device and the fourth RF output connector.

e) a fourth interface blade having a first end of the fourth interface blade, a second end of the fourth interface blade and a middle portion of the fourth interface blade, wherein the fourth interface blade is positioned between the fourth RF switch and the fourth control switch so that the first end of the fourth interface blade is able to make a contact with the fourth RF switch and the second end of the fourth interface blade is able to make a contact with the fourth control switch, and wherein the fourth interface blade is pivoted about the middle portion of the fourth interface blade so any movement of the first end of the fourth interface blade is countered by the second end of the fourth interface blade but in opposite direction; and f) a means for commanding the fourth interface blade.

13. The multipole multiposition microwave switch system with a common redundancy of claim 12 further comprising a) a fifth RF input connector attached to the housing;

b) a fifth RF output connector attached to the housing;

c) a fifth RF switch wherein the fifth RF switch is connected between the fifth RF input connector and the fifth RF output connector; and d) a fifth control switch wherein the fifth control switch is connected between the redundant RF input device and the fifth RF output connector.

e) a fifth interface blade having a first end of the fifth interface blade, a second end of the fifth interface blade and a middle portion of the fifth interface blade, wherein the fifth interface blade is positioned between the fifth RF switch and the fifth control switch so that the first end of the fifth interface blade is able to make a contact with the fifth RF switch and the second end of the fifth interface blade is able to make a contact with the fifth control switch, and wherein the fifth interface blade is pivoted about the middle portion of the fifth interface blade so any movement of the first end of the fifth interface blade is countered by the second end of the fifth interface blade but in opposite direction; and f) a means for commanding the fifth interface blade.

14. The multipole multiposition microwave switch system with a common redundancy of claim 13 further comprising a) a sixth RF input connector attached to the housing;

b) a sixth RF output connector attached to the housing;

c) a sixth RF switch wherein the sixth RF switch is connected between the sixth RF input connector and the sixth RF output connector; and d) a sixth control switch wherein the sixth control switch is connected between the redundant RF input device and the sixth RF output connector.

e) a sixth interface blade having a first end of the sixth interface blade, a second end of the sixth interface blade and a middle portion of the sixth interface blade, wherein the sixth interface blade is positioned between the sixth RF switch and the sixth control switch so that the first end of the sixth interface blade is able to make a contact with the sixth RF switch and the second end of the sixth interface blade is able to make a contact with the sixth control switch, and wherein the sixth interface blade is pivoted about the middle portion of the sixth interface blade so any movement of the first end of the sixth interface blade is countered by the second end of the sixth interface blade but in opposite direction; and f) a means for commanding the sixth interface blade.

15. The multipole multiposition microwave switch system with a common redundancy of claim 14 further comprising a) a seventh RF input connector attached to the housing;

b) a seventh RF output connector attached to the housing;

c) a seventh RF switch wherein the seventh RF switch is connected between the seventh RF input connector and the seventh RF output connector; and d) a seventh control switch wherein the seventh control switch is connected between the redundant RF input device and the seventh RF output connector.

e) a seventh interface blade having a first end of the seventh interface blade, a second end of the seventh interface blade and a middle portion of the seventh interface blade, wherein the seventh interface blade is positioned between the seventh RF switch and the seventh control switch so that the first end of the seventh interface blade is able to make a contact with the seventh RF switch and the second end of the seventh interface blade is able to make a contact with the seventh control switch, and wherein the seventh interface blade is pivoted about the middle portion of the seventh interface blade so any movement of the first end of the seventh interface blade is countered by the second end of the seventh interface blade but in opposite direction; and f) a means for commanding the seventh interface blade.

* * * * *